US008052352B2

(12) United States Patent
Bolton et al.

(10) Patent No.: US 8,052,352 B2
(45) Date of Patent: Nov. 8, 2011

(54) MINE SUPPORT HAVING A LINEARLY MOVEABLE AND/OR PIVOTING END PLATE

(75) Inventors: Wallace Bolton, Harrogate, TN (US); Demrey G. Brandon, Pittsburgh, PA (US); Ben Mirabile, Lerona, WV (US); John G. Oldsen, Butler, PA (US); John C. Stankus, Canonsburg, PA (US); Rodney Poland, Morgantown, WV (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 868 days.

(21) Appl. No.: 11/732,067

(22) Filed: Apr. 2, 2007

(65) Prior Publication Data

US 2008/0240868 A1 Oct. 2, 2008

(51) Int. Cl.
*E21D 15/00* (2006.01)

(52) U.S. Cl. ..... 405/290; 405/288; 405/294; 248/351

(58) Field of Classification Search ..... 405/272, 405/288, 290, 294; 248/351, 354.1, 354.3
See application file for complete search history.

(56) References Cited

U.S. PATENT DOCUMENTS

| | | | | |
|---|---|---|---|---|
| 5,228,810 | A * | 7/1993 | Seegmiller | 405/290 |
| 5,400,994 | A * | 3/1995 | Shawwaf et al. | 248/354.3 |
| 5,413,436 | A * | 5/1995 | Merz | 405/290 |
| 5,484,130 | A * | 1/1996 | Domanski et al. | 248/354.3 |
| 5,564,867 | A * | 10/1996 | Domanski et al. | 405/290 |
| 5,720,581 | A * | 2/1998 | Bacon et al. | 405/290 |
| 7,134,810 | B2 | 11/2006 | Stankus et al. | |
| 2004/0223815 | A1 * | 11/2004 | Stankus et al. | 405/288 |

* cited by examiner

*Primary Examiner* — John Kreck
*Assistant Examiner* — Sean Andrish
(74) *Attorney, Agent, or Firm* — The Webb Law Firm

(57) ABSTRACT

A mine support yieldable prop includes a threaded shaft rotatably mounted in an end of the prop to move into and out of the prop end to move a bearing plate toward or away from a mine roof, and/or a bearing plate pivotally mounted to the end of the prop to level the prop with uneven mine roofs.

12 Claims, 12 Drawing Sheets

MINE SUPPORT HAVING A LINEARLY MOVEABLE AND/OR PIVOTING END PLATE

BACKGROUND OF THE INVENTION

1. Field of the Invention

This invention relates to a mine support, e.g. a mine roof prop having a linearly moveable, and/or pivoting, end plate, e.g. a bearing plate, and more particularly, to a yieldable mine roof prop having a bearing plate mounted on one end of a threaded shaft with the other end of the shaft mounted in an end of the prop, or having a bearing plate pivotally mounted on the end of the prop, or pivotally mounted on the end of the threaded shaft.

2. Description of the Presently Available Technology

In general, a mine roof support system includes a plurality of yieldable props, each prop having one end supported on the mine floor and the other end engaging the mine roof, or two or more two yielding props connected to one another by a support cross member. The yieldable props presently available have an inner conduit slidably mounted into an outer conduit and held at a desired length by a clamp assembly used alone or in combination with a collapsible member or insert. Embodiments of clamping assemblies and collapsible members are disclosed in U.S. Pat. No. 7,134,810 B2, which patent is hereby incorporated by reference.

As is appreciated by those skilled in the art, as a compression load, e.g., a shifting mine tunnel roof or floor acts on an end of the prop, the inner conduit slides into the outer conduit. Although the props presently available are acceptable for mine roof support systems, there are limitations. For example, the force of the clamping arrangement that maintains the conduits in a fixed relationship to one another controls the load that the prop can take before it compresses. Because the props are usually manually set and the clamp assembly manually adjusted in the mines, there is a variation in the compressive load each prop can support before collapsing. The limitations of props with clamping assemblies, e.g. the variation in the compressive load is eliminated by using collapsible inserts, e.g. of the type disclosed in U.S. Pat. No. 7,134,810 B2, to carry the load instead of the clamping arrangements.

Although props having clamping arrangements and collapsible inserts eliminate the limitations of the props having clamping arrangements alone, they also have limitations. More particularly, in the instance when the mine roof or floor is not level, an uneven compressive load is applied to the engaging surface of the bearing plate and to the insert.

As can be appreciated by those skilled in the art, it would be advantageous to provide a prop for a mine roof support system that does not have the limitations of the presently available props.

SUMMARY OF THE INVENTION

The invention relates to a yieldable prop having, among other things, at least one conduit having a first end and an opposite second end, and a hollow portion extending from the first end toward the second end, and a bearing plate assembly. The bearing plate assembly includes, among other things, a threaded shaft having a first end and an opposite second end with the first end of the threaded shaft mounted to the support member, and a body having a first side and an opposite second side with the first side of the body supported on the first end of the at least one conduit. The body has a threaded passageway to receive the threaded shaft with the second end of the threaded shaft in the first end of the at least one hollow conduit, wherein rotating the body in a first direction moves the support member to increase spaced distance between the support member and the first side of the body, and rotating the body in a second opposite direction moves the support member to decrease the spaced distance between the support member and the first side of the body.

The invention further relates to a yieldable prop having, among other things, at least one conduit having a first end, an opposite second end, and a moveable bearing plate assembly mounted on the first end of the at least one conduit. The moveable bearing plate assembly includes, among other things, a support member having a convex surface, an opposite concave surface and a center hole. A plate member has a bowl-shaped center portion with the convex surface of the plate member supported on the concave surface of the support member, and with the bowl-shaped center portion having a center hole, and a shaft having a retaining end, the retaining end passing through the center hole of the support member and the plate member with engaging portions of the concave surface of the bowl shaped center portion of the plate member and with opposite second end of the shaft fixed to the first end of the at least one prop, wherein the center portion of the plate member is captured in the concave surface of the support member and is free to rotate in the X. Y and Z axis.

DETAILED DESCRIPTION OF THE INVENTION

Figure 1:
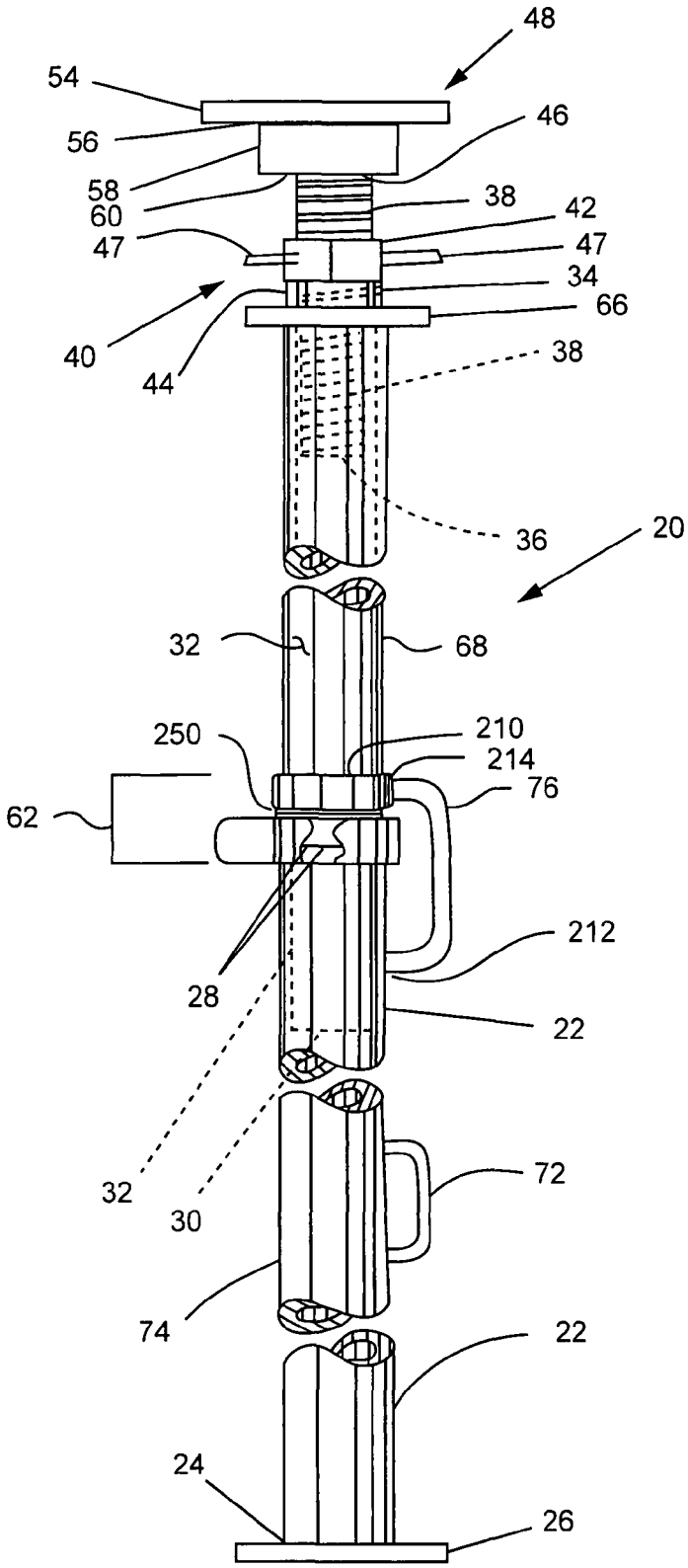
FIG. 1 is an elevated side view of a non-limiting embodiment of a prop having a non-limiting embodiment of a bearing plate assembly of the invention.

In the following discussion of non-limiting embodiments of the invention, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the practice of the invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, and all subranges in between, e.g., 1 to 6.3, or 5.5 to 10, or 2.7 to 6.1.

Further, in the discussion of the non-limiting embodiments of the invention, it is understood that the invention is not limited in its application to the details of the particular non-limiting embodiments shown and discussed since the invention is capable of other embodiments. Further, the terminology used herein is for the purpose of description and not of limitation and, unless indicated otherwise, like reference numbers refer to like elements.

Shown in FIG. 1 is a non-limiting embodiment of a prop of the invention designated by the numeral 20. The prop 20 includes a first hollow conduit 22 having a first end 24 secured to a bearing plate 26, and an opposite second end 28 receiving the first end 30 of the second conduit 32. The second conduit 32 is slidably positioned in the first hollow conduit 22 in a telescoping relationship. Therefore, the outer diameter of the portion of the second conduit 32 in the first conduit 22 is less than the inner diameter of the first conduit 22. The second conduit 32 can be a solid conduit having a hollow opposite the second end 34 and is preferably a hollow conduit. A first end 36 of threaded shaft 38 of elevator arrangement 40 incorporating features of the invention is slidably mounted in the second end 34 of the second conduit 32. The outer surface of the threaded shaft 38 and inner surface of the second conduit 32 at the second end 34 are sized relative to one another for the threaded shaft 38 to freely slide into and out of the second end 34 of the second conduit 32.

The elevator arrangement 40 includes the threaded shaft 38 passing through a nut 42 having one side 44 seated on the second end 34 of the second conduit 32 or on a mating surface. With this arrangement, rotating the nut 42 in a first direction while seated on the second end 34 of the second conduit 32 moves the threaded shaft 38 out of the second end 34 of the second conduit 32, increasing the distance between the opposite second end 46 of the threaded shaft 38 and the side 44 of the nut 42, and moving the threaded shaft 38 in a second opposite direction moves the threaded shaft 38 into the second end 34 of the second conduit 32 decreasing the distance between the second end 46 of the threaded shaft 38 and the side 44 of the nut 42. As can be appreciated, the nut 42 can be rotated in the first and/or second direction by a wrench (not shown), or in the non-limiting embodiment shown in FIG. 1, by handles 47 secured to the nut 42. A bearing platform 48 is securely mounted on the second end 46 of the threaded shaft 38. The bearing platform 48 includes a plate member 54 securely mounted on surface 56 of spacer block 58 with opposite surface 60 of the spacer block 58 securely mounted on the second end 46 of the threaded shaft 38.

With continued reference to FIG. 1, clamp assembly 62 engages the first conduit 22 and the second conduit 32 in a manner discussed below, such that with the clamp assembly 62 in the engaging position, the second conduit 32 is prevented from moving into the first conduit 22, and with the clamp assembly 62 in the non-engaging position, the second conduit 32 is free to move into and out of the first conduit 22. A lift plate 66 is mounted on the outer surface 68 of the second conduit 32 adjacent the second end 34 of the second conduit 32 for ease of moving the second conduit 32 into and out of the first conduit 22 when the clamp assembly 62 is in the non-engaging position to set the prop to a first length or height discussed in more detail below.

As can be appreciated, the invention is not limited to the technique used to fixedly secure components of the prop 20 to one another, e.g. the first end 24 of the first conduit 22 to the bearing plate 26, the lift plate 66 to the outer surface 64 of the second conduit 32, and/or the spacer block 58 to the second end 50 of the threaded shaft 38. In one non-limiting embodiment of the invention, components of the prop were fixedly secured together by welding. Further, the invention is not limited to the dimensions of the components of the prop 20. More particularly and not limiting to the invention, the first conduit 22 can be a cylindrical hollow pipe such as a nominal 3½ inch schedule 40 pipe, a nominal three inch schedule 40 pipe, a nominal 3 inch schedule 80 pipe, or a two and one-half inch schedule 40 pipe; the second conduit 32 can be a cylindrical hollow pipe such as a nominal 3 inch schedule 40 pipe or a 2½ inch schedule 40 pipe, and the threaded shaft can be a 2 inch diameter shaft. The components of the prop 20, unless indicated otherwise, are each preferably made from metal, such as steel with the first and second conduits having a wall thickness of approximately ⅛ to ¾ inch. Although in the preferred practice of the invention, the conduits 22 and 32 are cylindrically shaped conduits (pipes), alternatively shaped conduits are also contemplated. Moreover, for reasons discussed below, the length of the first and second conduits 22, 32, and of the threaded shaft 38 should be selected as a function of seam height, i.e. distance between mine floor and ceiling to obtain maximum benefits and allow for maximum overlap of the first conduit 22, second conduit 32, and threaded shaft 38 when the conduits and threaded shaft are fully nested together.

For ease of lifting and moving the prop 20, a first handle 72 is secured to the outer surface 74 of the first conduit 22, and a second handle 76 has one end preferably attached to the clamp assembly 62 in a manner discussed below, and the other end is attached to the outer surface 74 of the first conduit 22 to help prevent the clamp assembly 62 and the prop 20 from becoming disassembled in a manner discussed below, during shipping or handling of the prop 20.

Figures 2, 2A:
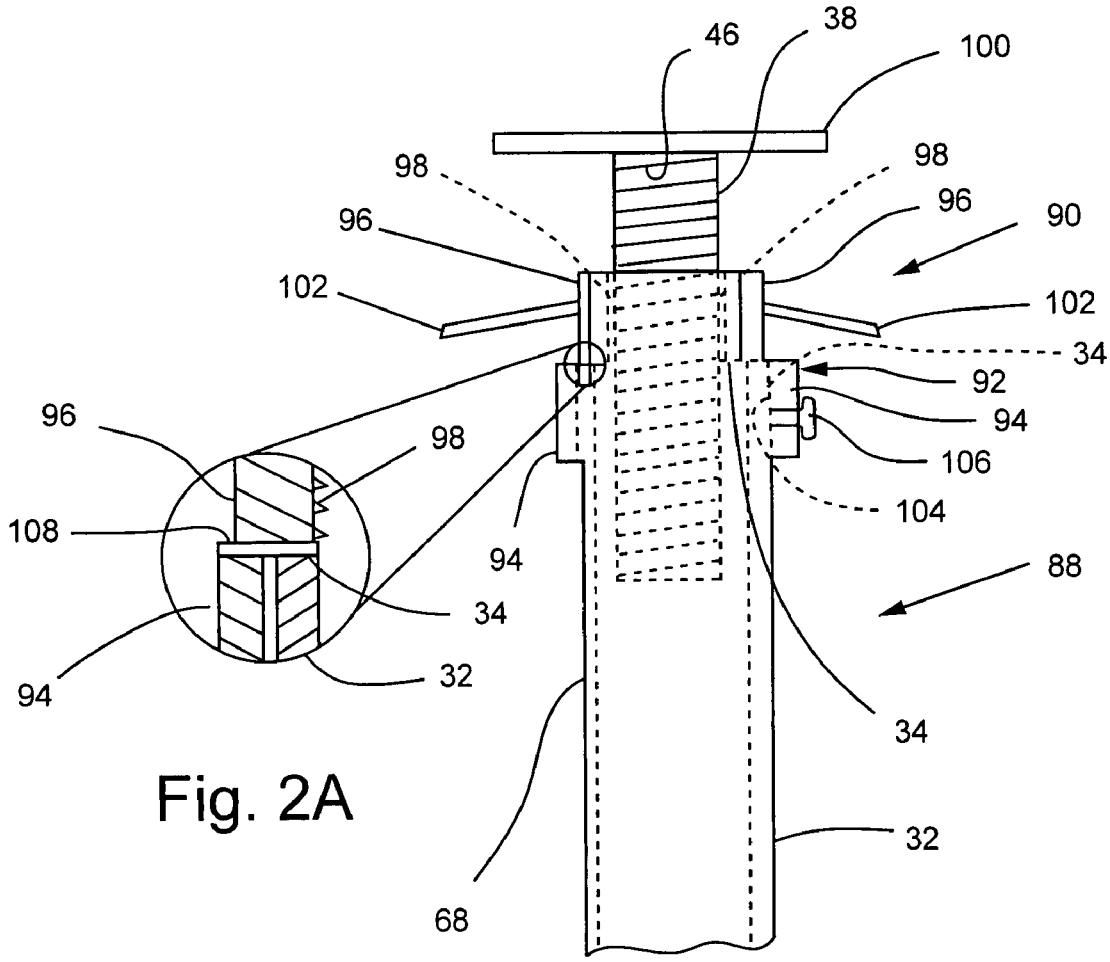
FIG. 2 is an elevated side view of an end portion of a prop having another non-limiting embodiment of a bearing plate assembly of the invention.

Shown in FIG. 2 is another non-limiting embodiment of a prop of the invention designated by the number 88. The prop 88 includes an elevator arrangement 90 mounted on the second end 34 of the second conduit 32 in a manner discussed below. The remainder of the prop 88 not shown in FIG. 2, in one non-limiting embodiment of the invention, includes the clamp assembly 62; the first conduit 22 and the bearing plate 26 (see FIG. 1). The elevator arrangement 90 includes a collar 92 having a first section 94 and a second section 96. The first section 94 has an internal diameter larger than the outer diameter of the second conduit 32 at the second end 34 of the second conduit, the second section 96 has an inside diameter smaller than the outside diameter of the second conduit 32, and equal to or slightly smaller than the inside diameter of the second conduit 32, at the second end 34 of the second conduit 32. The inner surface of the second section 96 of the collar 92 has threads 98 sized to receive the threaded shaft 38. With this arrangement, rotating the section 96 of the collar 92 in a first direction moves the threaded shaft 38 out of the second end 34 of the second conduit 32, increasing the distance between the second end 46 of the threaded shaft 38 and the collar 92, and rotating the section 96 of the collar 92 in a second opposite direction moves the threaded shaft 38 into the second end 34 of the second conduit 32, decreasing the distance between the second end 46 of the threaded shaft 38 and the collar 92. In one non-limiting embodiment of the invention, the second conduit 32 was a cylindrical hollow conduit having an outside diameter of 2⅞ inches and an inside diameter of 2⅜ inches. The first section 94 of the collar 92 had an outside diameter of 3½ inches, a height of 1½ inches and a wall thickness of 0.30 inch and the second section 96 had an outside diameter of 3½ inches, a height of 2 inches and a wall thickness of 0.50 inch. The inner surface of the second section 96 of the collar 92 had threads 98 to receive the threaded shaft 38.

With continued reference to FIG. 2, a bearing plate 100 is securely mounted on the second end 46 of the threaded shaft 38 and is moved toward the mine roof when the second section 96 of the collar 92 is rotated in the first direction and moved away from the mine roof when the collar 92 is rotated in the second direction. As can be appreciated, the second section 96 of the collar 92 can be rotated in any convenient manner, for example but not limiting to the invention, by the handles 47 secured to the outer surface of the second section 96 of the collar 92. Preferably but not limiting to the invention, the handles 102 are angled away from the bearing plate 100 to avoid hitting the bearing plate 100 as the handles 102 and the second section of the collar 92 are rotated. The collar 92 can be secured to the second end 34 of the second conduit 32 in any convenient manner. In one non-limiting embodiment of the invention, the first section 94 of the collar 92 is set in a non-moveable position by the end 104 of a machine screw 106 passing through the wall of the first section 94 of the collar 92 and engaging the outer surface 68 of the second conduit 32 or passing through a threaded hole (not shown) in the second conduit 32.

As can be appreciated, a metal surface moving over a metal surface causes friction. With reference to FIG. 2A, in a non-limiting embodiment of the invention, the surfaces of the first and second sections 94, 96 of the collar 92 contacting one another can have a layer 108 of non-friction or low friction material, e.g. of the type sold under the trademark TEFLON or by coating the mating metal surfaces with a copper layer.

Figure 3:
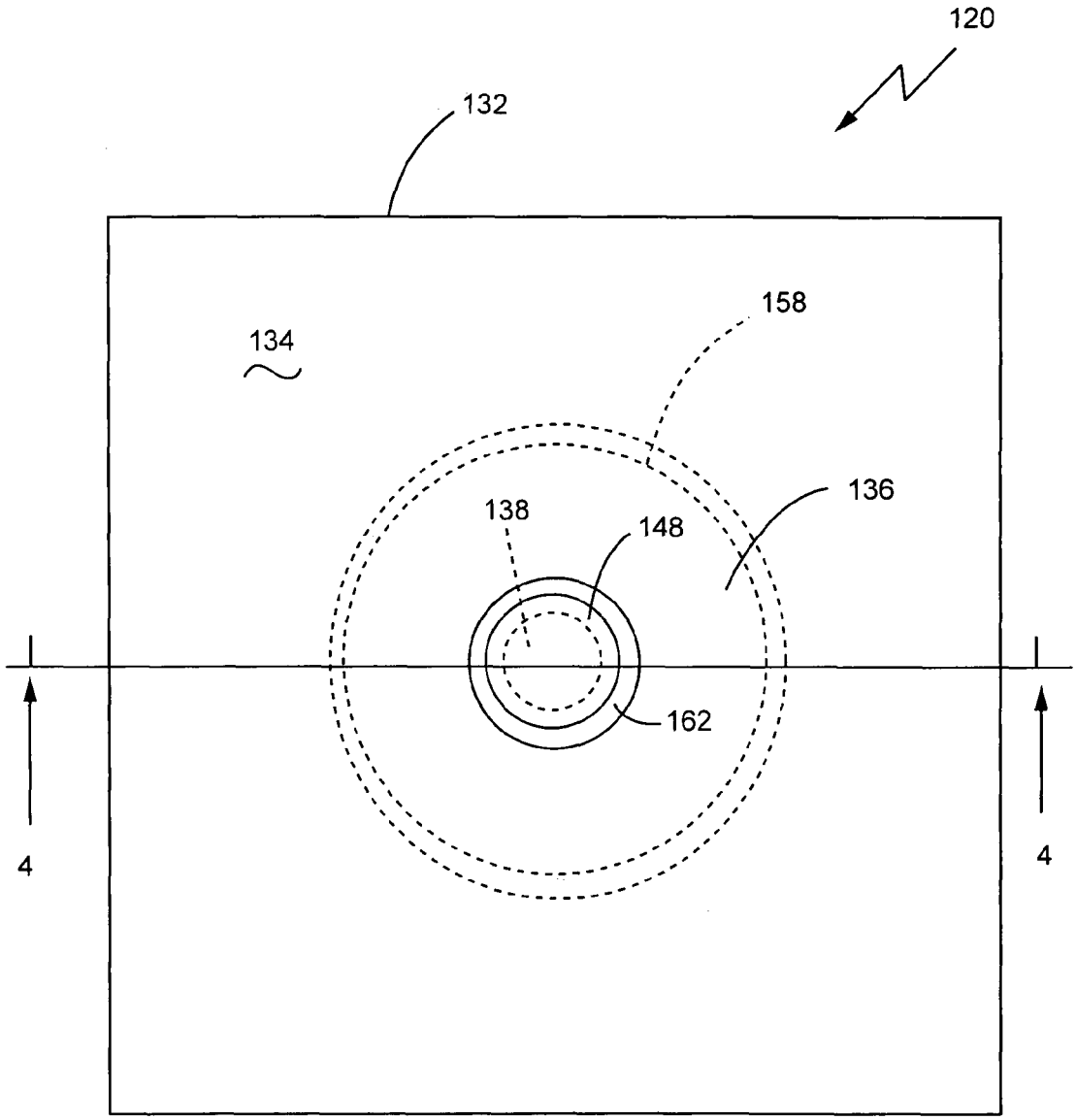
FIG. 3 is an elevated plane view of still another non-limiting embodiment of a bearing plate assembly of the invention.
Figure 4:
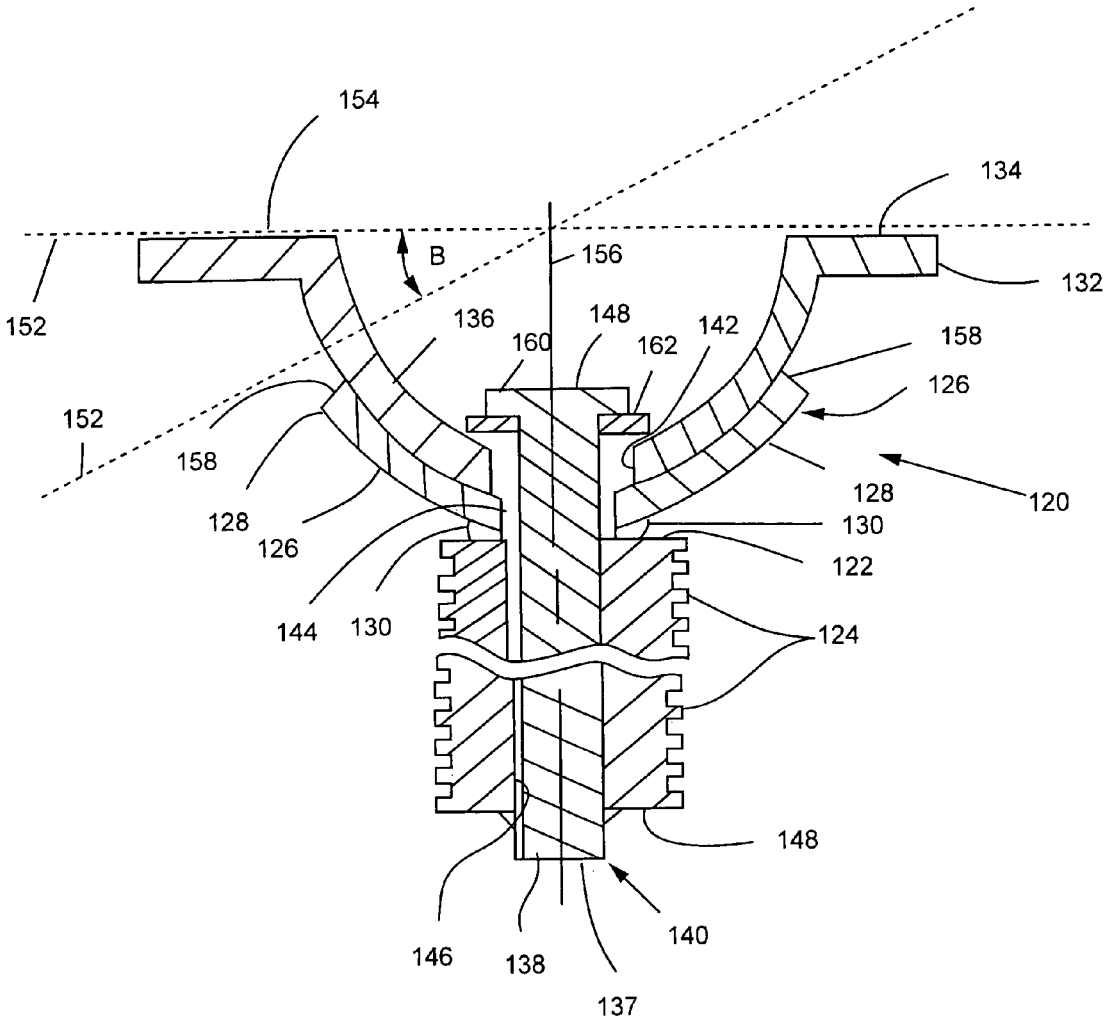
FIG. 4 is a view taken along lines 4-4 of FIG. 3.

With reference to FIGS. 3 and 4, and in particular, FIG. 4, there is shown a non-limited embodiment of a bearing plate assembly 120 of the invention mounted on first end 122 of threaded shaft 124 in a manner discussed below. The bearing plate assembly 120 includes a bowl-shaped member 126 having an outer convex surface 128 secured to the first end 122 of the threaded shaft 124 in any convenient manner, e.g. by tack welds 130 (clearly shown in FIG. 4). A bearing plate 132 has flat marginal edge portions 134 circumscribing a convex center portion 136. The elongated body 138 of a headed shaft 140 passes through the center hole 142 of the convex center portion 136 of the bearing plate 132, through the center hole 144 in the bowl-shaped member 126, and is secured in a passageway 146 in the threaded shaft 124, in any convenient manner, e.g. by welding or providing threads an outer surface of the elongated body 138 and surfaces of the passageway 146. In another non-limiting embodiment of the invention, end 148 of the headed shaft 140 extends out of the passageway 146 and a portion of the elongated body 138 of the headed shaft 140 is tack welded to the second end 148 of the threaded shaft 124. With this arrangement and as shown in FIG. 4, plane 152 containing the engaging surface 154 of the bearing plate 132 in the initial position is normal to center axis 156 of the headed shaft 140, and the plane 152 can be pivoted to a maximum angle B at any position around the headed shaft 140

With continued reference to FIG. 4, the difference between the diameter of the center hole 142 in the convex center portion 136 of the bearing plate 132 and the diameter of the elongated body 138 of the headed shaft 140, and the distance between periphery 158 of the bowl-shaped member 126 and the marginal edge portions 134 of the bearing plate determine the maximum degrees of the angle B. More particularly, as the difference between the diameter of the hole 142 in the convex center portion 136 of the bearing plate 132 and the diameter of the elongated body 138 of the headed shaft 140 increases while keeping the distance between periphery 158 of the bowl-shaped member 126 and the marginal edge portions 134 of the bearing plate constant, the maximum degree of the angle B decreases and vise versa. As the distance between periphery 158 of the bowl shaped member 126 and the marginal edge portions 134 of the bearing plate decreases while the difference between the diameter of the hole 142 in the convex center portion 136 of the bearing plate 132 and the diameter of the elongated body 138 of the headed shaft 140 remain constant, the maximum degree of the angle B decreases and vise versa.

In one non-limiting embodiment of the invention, the bearing plate 132 had 8 inches by 8 inches sides, the convex center portion 132 had a diameter of 5 inches, and the hole 142 of center portion 132 had a diameter of 1⅜ inches. The diameter of the elongated body 138 of the headed shaft 140 was ⅞ inch and the diameter of the hole 144 of the bowl-shaped member was 1⅜ inches and the distance between periphery 158 of the bowl-shaped member 126 and the marginal edge portions 134 of the bearing plate was 1 inch, to provide the range of 0 to 14.24 degrees for the angle B. As can be appreciated, the invention is not limited to the range of degrees of the angle B, however in selecting the range of the angle B, care should be exercised not to set the bearing plate at an angle to the mine roof such that average increases in the load on the bearing plate 132 will cause the prop to be angled from between the mine floor and roof. In the practice of the invention, an angle B in the range of 0 to 5 degrees can be used; an angle B in the range of 0 to 15 degrees is preferred and an angle B in the range of 0 to 30 degrees is more preferred. As can further be appreciated, head 160 of the headed shaft 140 should not be sized to pass through the hole 142 of the bearing plate 132. As an added safety measure, but not limiting to the invention, a washer 162 can be providing on the elongated body 138 of the headed shaft 140 between the head 160 of headed shaft 140 and the center portion 136 of the bearing plate 132.

Figure 5:
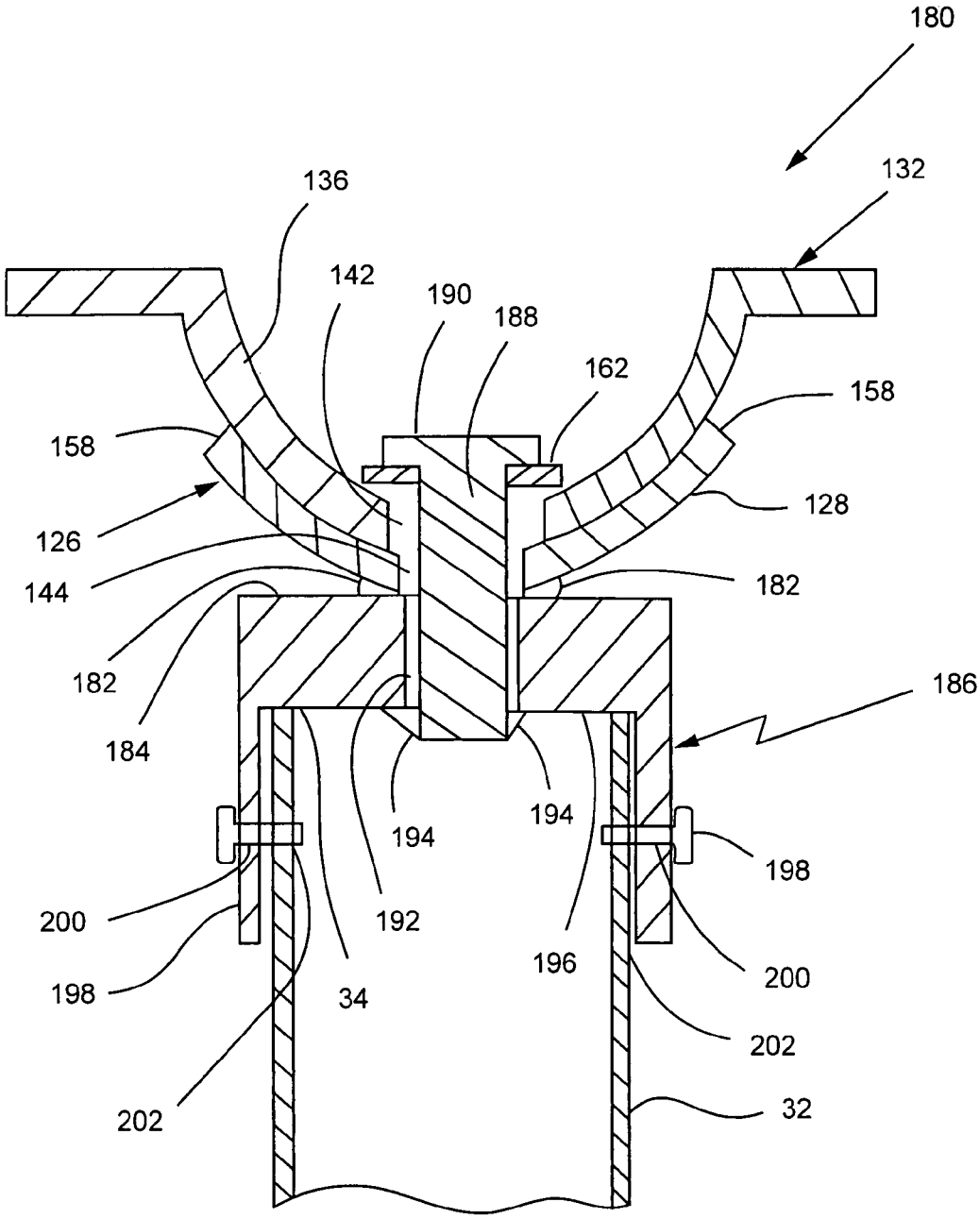
FIG. 5 is a view similar to the view of FIG. 4 showing other non-limiting embodiments of a bearing plate assembly of the invention.
Figure 6:
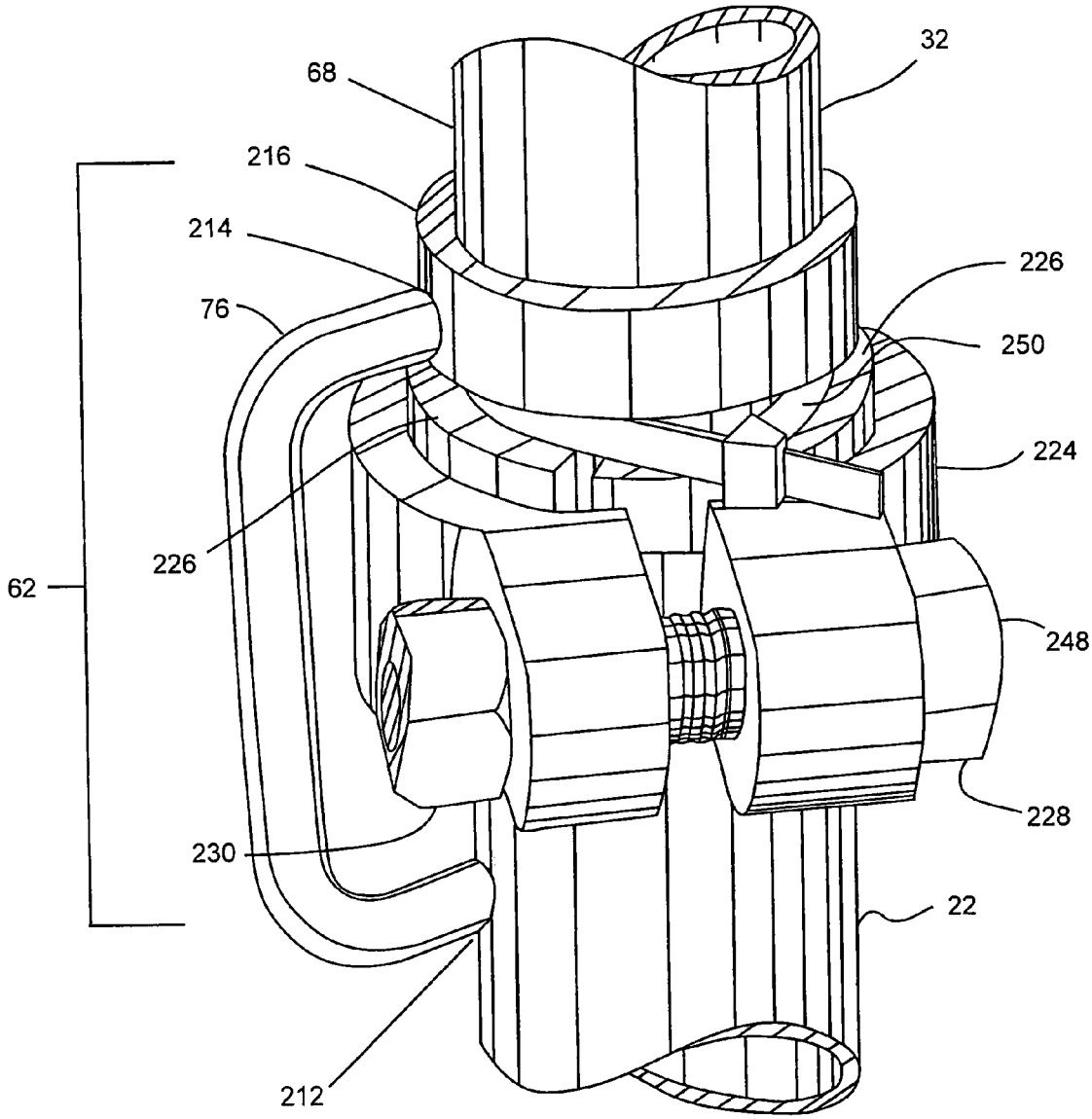
FIG. 6 is a partial perspective side view of a clamp assembly that can be used in the practice of the invention.

Shown in FIG. 5 is anther non-limiting embodiment of a bearing plate assembly of the invention designated by the number 180. The convex surface 128 of the bowl shaped member 126 in this embodiment of the invention is tack welded at 182 to outer end surface 184 of end cap 186. The elongated body 188 of headed shaft 190 passes through the washer 162, the hole 142 in the center of the convex portion 136 of the bearing plate 132, the hole 144 in the bowl shaped member 126 and the passageway 192 in the end cap 186, and is tack welded at 194 to inner end surface 196 of the end cap 186. The end cap 186 is mounted on the second end 34 of the second conduit 32 and secured in position on the second conduit 32 by one or more bolts 198 (two shown in FIG. 5) passing through the hole 200 in the end cap 186 and threaded into the hole 202 in the second conduit 32.

Although the discussions of the non-limiting embodiments of the invention were directed to mounting the elevator arrangement 40 (see FIG. 1), the elevator arrangement 90 (see FIG. 2), the bearing plate assembly 120 (see FIG. 4) and the bearing plate assembly 180 (see FIG. 5) on the second end 34 of the second conduit 32, the invention contemplates mounting the elevator arrangements 40 and 90, and bearing plate assemblies 120 and 180 on the first end 24 of the first conduit 22. In this instance, the bearing plate 26 shown secured on the first end 24 of the conduit 22 could be secured on the second end 34 of the second conduit 32. The invention further contemplates mounting one of the elevator arrangements 40 or 90, or one of the bearing plate assemblies 120 or 180 on one end of the prop 20, and one of the elevator arrangements 40 or 90, or one of the bearing plate assemblies 120 or 180 on the opposite end of the prop 20.

Referring back to FIG. 1, the clamp assembly 62 is not limiting to the invention, and any type of clamp assembly known in the art to optionally provide for moving the second conduit 32 into and/or out of the first conduit 22, and provide for preventing movement of the second conduit 32 into and/or out of the first conduit 22 can be used in the practice of the invention. As is appreciated by those skilled in the art, as a compression load acts to compress the prop 20, such as a shifting mine tunnel roof, the clamp assembly 62 will slip and the second conduit 32 will gradually telescope back into the first conduit 22. Further, compression of the prop 20 can drive the first conduit 22 into the clamp assembly 62. At this point, further loading can begin to buckle the first and second conduits 22, 32, or the clamp assembly 62 can split the second end 28 of the first conduit 22. The buckling of the first and second conduits 22, 32 can be postponed by making the first conduit 22 and the second conduit 32 substantially overlap one another. Also, increasing wall thickness of the first and second conduits 22, 32 can help to retard buckling of the prop 20. In the following discussion and not limiting to the invention, the clamp assemblies disclosed in U.S. Pat. No. 7,134,810 B2 are used in the practice of the invention.

With reference to FIGS. 6-11 as needed, the clamp assembly 62 is positioned at the juncture of the first and second conduits. A ring 210 is slidably positioned around the outer surface of the second conduit 32. The handle 76 has one end portion 212 attached to the outer surface of the first conduit 22 and a second end portion 214 is attached to the ring 210 to help prevent the clamp assembly 62 and the prop 20 from becoming disassembled during shipping or handling. The clamp assembly 62 includes a housing 224 (see FIGS. 6-9), a wedge 226 (see FIGS. 6, 10 and 11), a bolt 228, and a nut 230 (see FIG. 6). The housing 224 is positioned on top of, and/or around, the first conduit 22 at the second end 28 (clearly shown in FIG. 1) of the first conduit 22 and overlaps a portion of the outer surface 68 of the second conduit 32 adjacent the second end 28 of the first conduit 22. The wedge 226 engages or is attached to the outer surface 68 of the second conduit 32 adjacent the second end 28 of the first conduit 22. The wedge 226 is configured to engage the housing 224 to prevent the second conduit 32 from further entering the first conduit 22.

With reference to FIGS. 7-11 as needed, the wedge 226 can be one or more pieces and preferably, the wedge 226 is a two-piece construction including a first wedge member 234 and a second wedge member 236. The first wedge member 234 and the second wedge member 236 form a generally hollow, cylindrical member having a tapered outer diameter. In this manner, the wedge 226 acts as a compressing member. More particularly, as the first and second wedge members 234, 236 move into the housing 224, inner surface 240 of the housing (FIG. 7) decreases the distance between adjacent ends of the wedge members 234, 236 moving the inner surfaces of the wedge members 234, 236 into engagement with the outer surface 68 of the second conduit 32. The first wedge member 234 and the second wedge member 236 are attached to the outer surface 68 of the second conduit 32 by clamping, welding, friction (from the housing 224), or other suitable method. The wedge 226 preferably includes a threaded inner surface 238 (shown only in FIG. 11) to improve the grip of the wedge 226 on the outer surface 68 of the second conduit 32.

Figure 7:
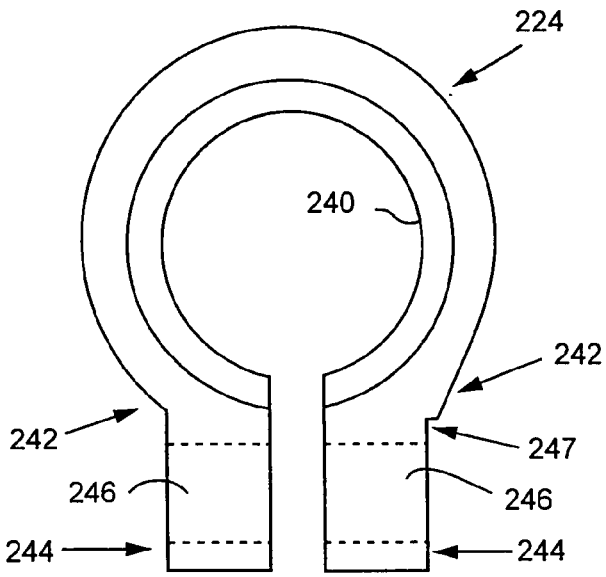
FIG. 7 is an elevated plane view of the housing of the clamp assembly shown in FIG. 6.
Figure 8:
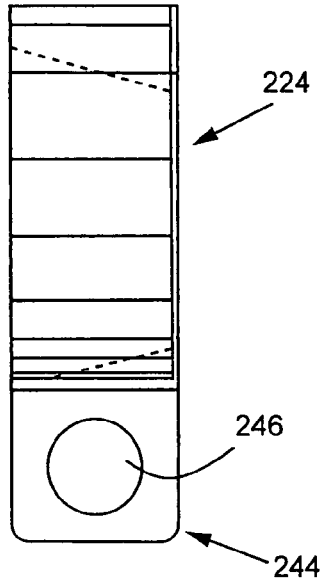
FIG. 8 is an elevated side view of the housing shown in FIG. 7.
Figure 9:
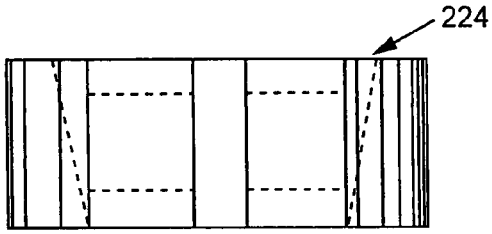
FIG. 9 is an elevated front view of the housing shown in FIG. 7.
Figure 10:
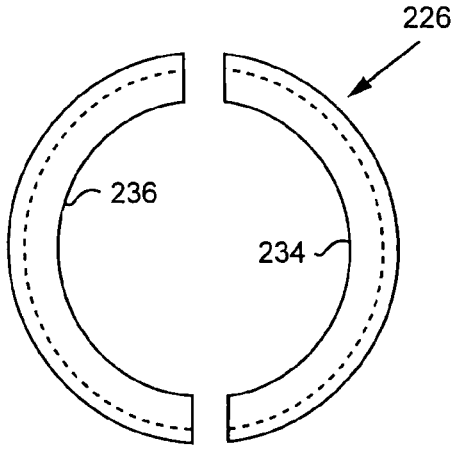
FIG. 10 is an elevated plane view of the wedge of the clamp assembly shown in FIG. 6.
Figure 11:
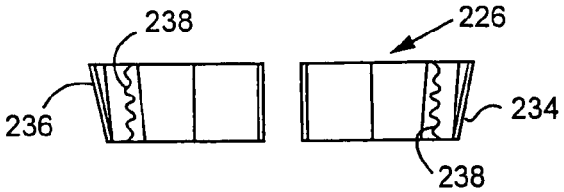
FIG. 11 is an elevated side view of the wedge shown in FIG. 10.

With reference to FIGS. 7, 10 and 11 as needed, the housing 224 has an inner surface 240 compatible with the shape of outer surface of the wedge 226, e.g., surfaces 234, 236. Because cylindrically shaped conduits are typically used (as shown in the drawings), the housing 224 is preferably generally C-shaped with opposed ends 242. A pair of parallel legs 244 extends from the opposed ends 242 of the housing 224. Each leg 244 includes a bolt opening 246 configured to receive the bolt 228 (shown only in FIG. 6) therethrough. The nut 230 is received on the bolt 228 and can be torqued to a calibrated load. The bolt openings 246 can include one or more recesses 247 for the seating of a bolt head 248 and/or the nut 230 (see FIGS. 6 and 7). The calibrated load is determined by a calibration curve plotting nut torque to load (residual or maintained). In a preferred non-limiting embodiment of the invention, the clamp assembly 62 will maintain 100% of the applied load to the housing 224 and wedge 226.

Because the clamp assembly 62 is a combination of pieces, the clamp assembly 62 can be vibrated loose during shipping. To eliminate this problem, a ring tie 250 (see FIG. 6) is removably positioned between the ring 210 and the clamp assembly 62 to maintain the wedge 226 in an engaged relationship with the housing 224.

Figure 12:
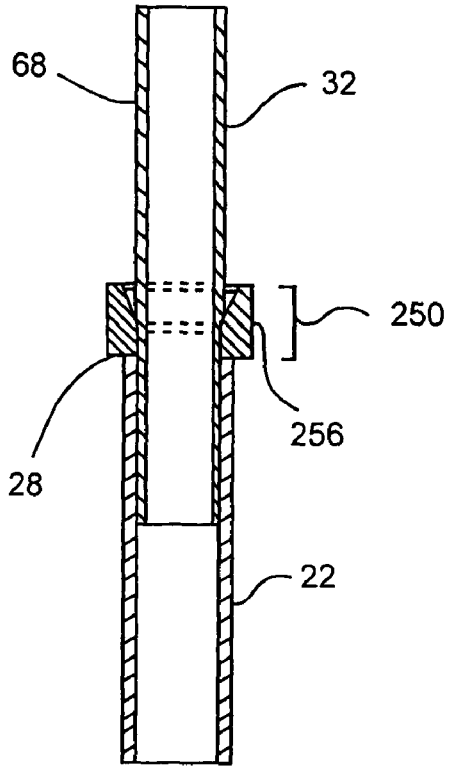
FIG. 12 is cross-sectional side view of another non-limiting embodiment of a clamp assembly that can be used in the practice of the invention to maintain a pair of conduits in fixed relation to one another.
Figure 13:
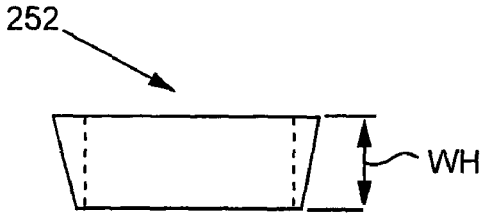
FIG. 13 is an elevated side view of the wedge of the clamp assembly shown in FIG. 12.
Figure 14:
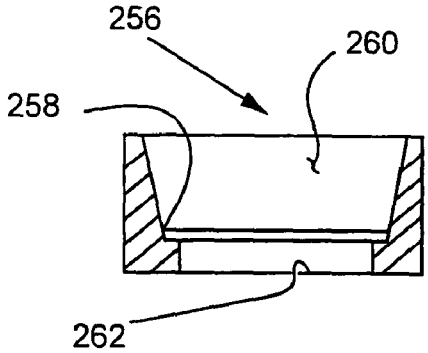
FIG. 14 is a cross-sectional side view of the housing of the clamp assembly shown in FIG. 12.

Shown in FIGS. 12-14 is another non-limiting embodiment of a clamp assembly designated by the number 250 including a wedge (252, FIG. 13) and housing 256, (FIG. 14) combination to provide predetermined loading. As shown in greater detail in FIG. 13, the wedge 252 is preferably a hollow cylindrical member having a height WH and a tapered outer diameter tapering to a base level outside diameter. The wedge 252 is attached to the outer surface 68 of the second conduit 32 by hardened threads, friction, clamping, welding, or other suitable method. The housing 256, shown in detail in FIG. 14, has a substantially static outer diameter, but includes an inner diameter that tapers to an intermediate internal diameter. A lip 258 is defined at the base level inner diameter of the housing 256, with the lip 258 and tapered inner diameter of the housing 256 defining a race 260 that receives the wedge 252.

Adjacent to the race 260, the housing 256 defines an internal cavity 262 that receives the second conduit 32 (clearly shown in FIG. 12). The housing 256 is positioned immediately adjacent to the second end 28 (see FIG. 12) of the first conduit 22 and, when adjusted to the desired height, the wedge 252 engaging the outer surface 68 of the second conduit 32, prevents the second conduit 32 from substantially further entering the first conduit 22.

Referring again to FIG. 12, when the wedge 254 and the housing 256 are employed, the housing 256 resists the outward force of the wedge 254 as the load acting on the second conduit 32 moves the second conduit into the first conduit 22. Movement of the wedge 254 into the housing 256 resists further movement of the second conduit 32 with respect to the first conduit 22 for a given load.

Figure 15:
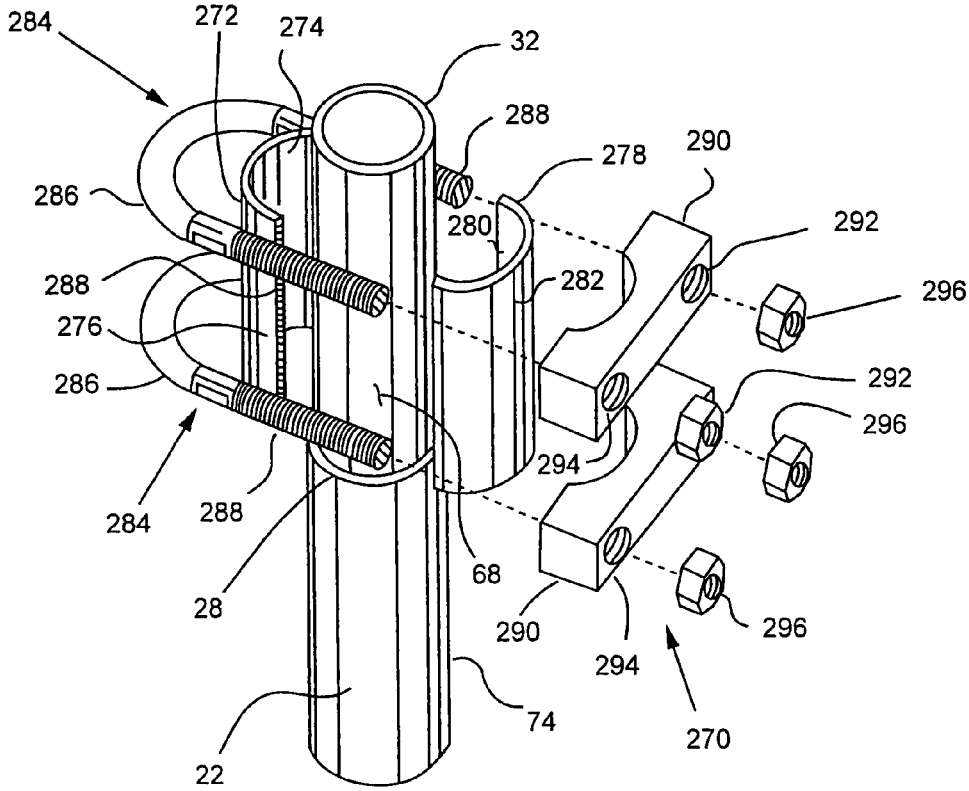
FIG. 15 is an exploded top perspective view of still another clamp assembly that can be used in the practice of the invention.
Figure 16:
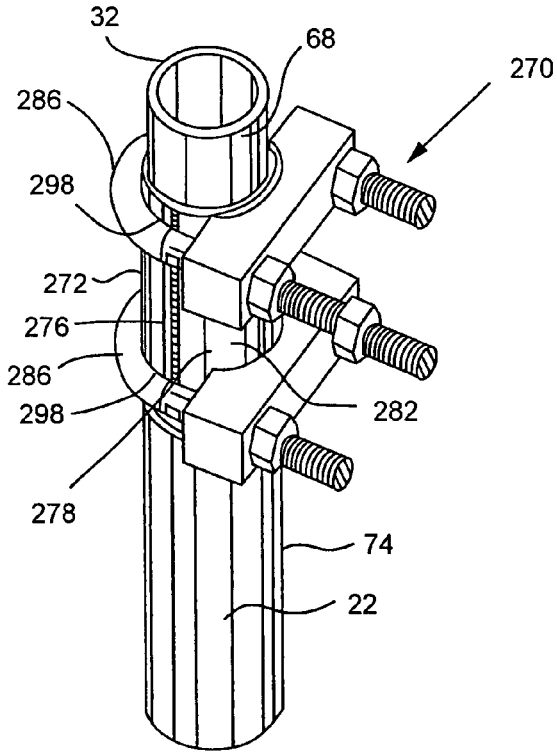
FIG. 16 is a perspective view of the assembled clamp assembly shown in FIG. 15.

Shown in FIGS. 15 and 16 is still another non-limiting embodiment of a clamp assembly designated by the number 270 and includes a first split conduit 272 defining a first split inner surface 274 and a first split outer surface 276, a second split conduit 278 defining a second split inner surface 280 and a second split outer surface 282, and a pair of bolts 284 each having an outer surface compatible with an outer shape of the conduit used. Because cylindrically shaped conduits are shown, the bolts 284 have a U-shaped portion 286 and two threaded legs 288. A brace 290 is provided for each bolt 284 and has an outer surface compatible with an outer shape of the conduit used, such as an arch-shaped as shown in FIGS. 15 and 16. Each of the braces 290 defines first and second leg orifices 292, 294 (shown clearly in FIG. 15). Internally threaded nuts 296 individually engage each threaded leg 288, and hardened or frictionless washers (not shown) can also be used in conjunction with the threaded nuts 296 to aid in torquing the threaded nuts 296. The first split conduit 272 and the second split conduit 278 are each preferably made from metal, such as steel, having a thickness of approximately ⅛ to ¾ inch. The U-shaped bolt or bolts 284, the arch-shaped braces 290, and the internally threaded nuts 296 are also preferably made from metal or other suitable material.

With reference to FIGS. 15 and 16 as needed, the first split inner surface 274 of the first split conduit 272 and the second split inner surface 280 of the second split conduit 278 are each, respectively, positioned partially around the outer surface 68 of the second conduit 32. The U-shaped portion 286 of the U-shaped bolts 284 is positioned adjacent to the first split outer surface 276 of the first split conduit 272. Each threaded leg 288 of each U-shaped bolt 284 extends through its respective first or second leg orifices 292, 294 defined by the braces 290. When the threaded nuts 296 are tightened, the U-shaped portion 286 of the U-shaped bolts 284 exerts a force on the first split conduit 272, while the brace 290 exerts a force on the second split conduit 278. In turn, the first and second split conduits 272, 278 each exert a force on the outer surface 68 of the second conduit 32.

Because the clamp assembly 270 is a combination of pieces, the clamp assembly 270 can be vibrated loose during shipping. To solve this problem, as shown in FIG. 16, the U-shaped portion 286 of the U-shaped bolts 284 is tack welded to split conduit 272 at 298. In another non-limiting embodiment of the invention, the handle 76 (see FIG. 1) can have one end portion 212 connected, e.g. by a tack weld, to the outer surface 74 of the first conduit 22 and the other end portion connected to the clamp assembly, e.g. to the split conduit of the clamp assembly 270.

Figure 17:
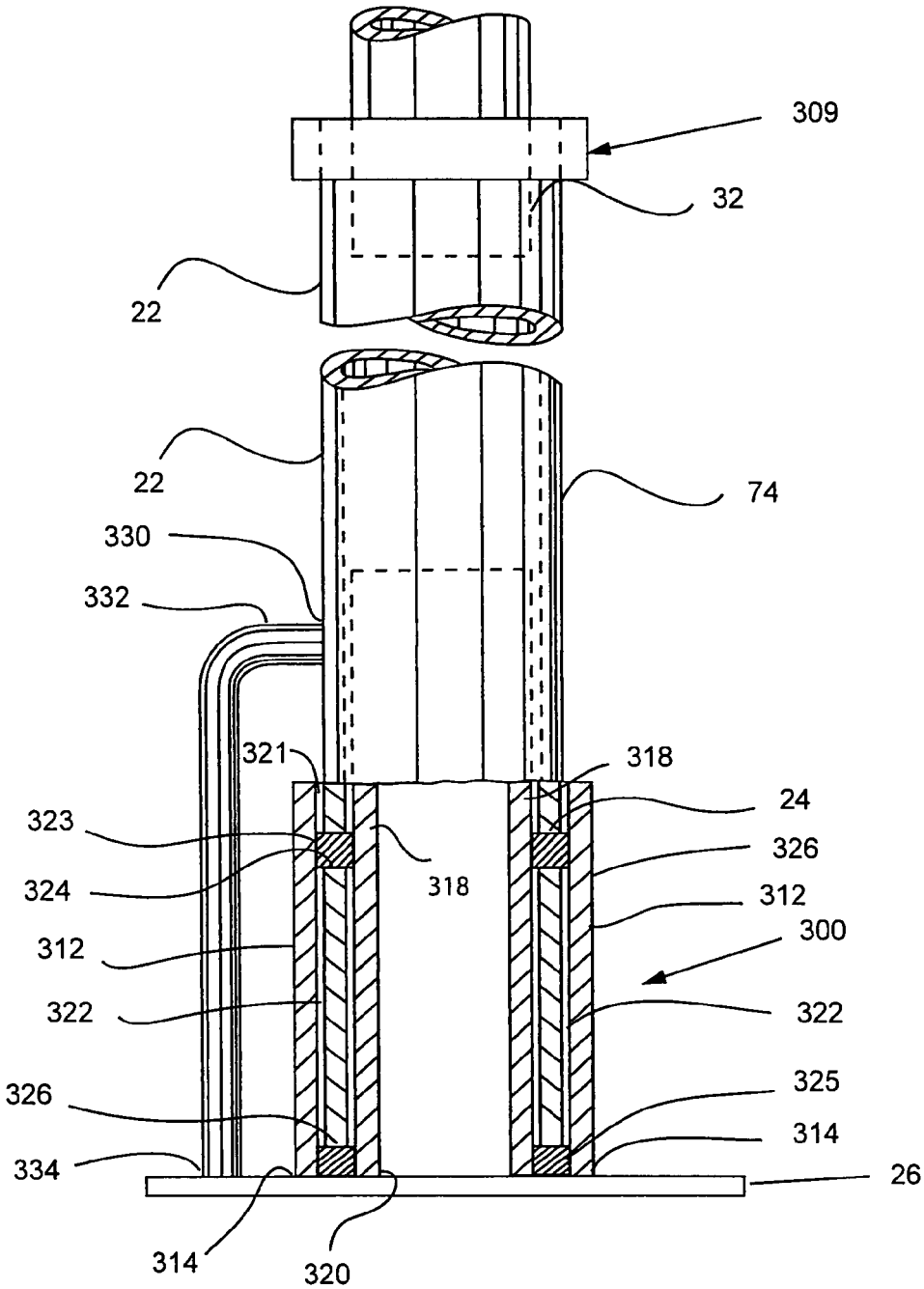
FIG. 17 is sectional side view of a prop having a yield section that can be used in the practice of the invention at one end of the prop, the yield section shown in cross section.
Figure 20:
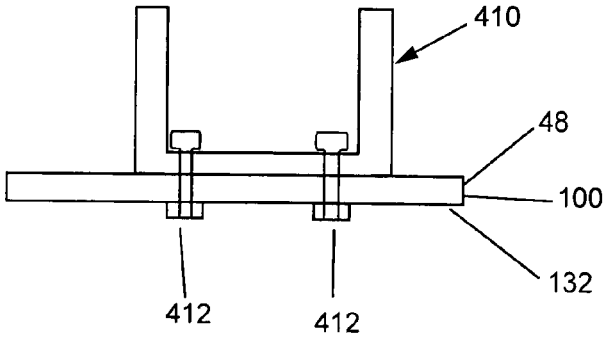
FIG. 20 is a view similar to view of FIG. 19, showing another non-limiting embodiment of the invention showing a beam bracket mounted on the end plates of the invention.

Optionally, the non-limiting embodiments of the elevator arrangements 40, 90, and the bearing plate assemblies 120, 180, can be used with a prop having a yield section of the type used in the art, e.g. of the type disclosed in U.S. Pat. No. 7,134,810 B2. For example and not limiting to the invention shown in FIG. 17, is a yield arrangement identified by the number 300 (shown in FIG. 20 of U.S. Pat. No. 7,134,810 B2). The first and second conduits 22, 32 are set in a relative position to one another in any convenient manner, e.g., but not limiting the invention thereto, using the jack assembly, e.g. and not limiting to the invention of the type discussed in U.S. Pat. No. 7,134,810 B2, and are secured in the relative position by clamp assembly 309. The clamp assembly can be any of the type used in the art, e.g. but not limited to one of the clamp assemblies discussed above.

The yield section 300 includes a shroud 312 having an end 314 welded to the bearing plate 26, and an inner pipe 318 having an end 320 welded to the plate 26 with the center axis of the shroud 312 and the inner pipe concentric to provide a space 321 therebetween for receiving an insert 322 capable of withstanding a predetermined compressive force before collapsing as discussed below. Optionally, an upper follower ring 323 is positioned between the end 24 of the first conduit 22 and end, e.g., upper end 324, of the insert 322, and a lower follower ring 325 is positioned between the bearing plate 26 and the lower end 326 of the insert 322.

In this discussion, the first conduit 22, the second conduit 32, the shroud 312, the insert 322, the follower rings 323, 325, and the inner pipe 318 have a circular cross section.

The insert 322 can be a single piece, a plurality of vertical pieces as mounted in the space 321, or of a plurality of conduit segments piled one on top of the other in the space 321. The sections or plurality of conduit segments can be made of material having the same or different compressive strength, e.g., for stage yielding (read U.S. Pat. No. 7,134,810 B2).

The lower follower ring 325, the insert 322, and the upper follower ring 323 are placed in the space 321 between the inner surface of the shroud 312 and the outer surface of the inner pipe 318, and the end portion 24 of the first conduit 22 moved over the inner pipe into the space 321 into contact with the upper follower ring 323. Preferably, the inner pipe has a length or height greater than the combined length or height of the follower rings 323, 325 and the insert 322, and the length or height of the shroud 312 has a length or height greater than the combined length or height of the follower rings 323, 325 and the insert 322 to guide the end portion 24 of the first conduit 22 into the space 321 and minimize sideward movement of the first conduit 22, e.g., provide vertical and lateral stability to the first conduit 22. The length of the inner pipe 318 extends into the first conduit 22 a length to provide the vertical and lateral stability while maintaining a spaced distance from the end 304 of the second conduit 32 to provide for the compression of the insert 322 without the end 304 of the second conduit 32 contacting the inner pipe 318 which can resist the downward motion of the first conduit 16 to compress the yield section.

The yield section 300 is maintained on the end 24 of the conduit 22 during shipping and handling by tack welding one end 330 of a handle 332, e.g., 0.5 inch diameter rod to the outer surface 74 of the first conduit 22, and the other end 334 of the handle 332 to the bearing plate 26 as shown in FIG. 17.

Although not required, the use of the upper follower ring 323 is recommended to provide for the application of a uniformly distributed compression force by the end portion 24 of the first conduit 22 to the upper surface of the insert 322, e.g. when the wall thickness of the first conduit 22 and the insert 322 are different, and/or the outer diameter of the first conduit 22 and the outer diameter of the insert 322 are different and/or the space 321 is sufficiently large to have misalignment of the end 24 of the first conduit 22 and the end of the insert 322. The use of the lower follower ring 325 is recommended when there is a probability that the weld mounting the end of the shroud to the bearing plate can be fractured and the lower portion of the insert can move outwardly by the compression of the insert. As can be appreciated, a solid bead of welding connecting the end of the shroud to the bearing plate is expected to be sufficient to withstand the force of the insert as it is compressed. The thickness of the lower ring is not limiting to the invention. Lower follower rings having a thickness of 0.50 inches have been used.

The first and second conduits 22, 32, and the follower rings 323, 325 should be made of a material and have a thickness to withstand higher compression forces than the insert. In this manner, the insert will collapse under a given load before the conduits and follower rings collapse. For compression loads of 50 to 60 tons, shrouds and inner pipes made of schedule 10 conduits or greater can be used in the practice of the invention. Preferably, but not limiting to the invention, schedule 40 conduits are preferred.

Figure 18:
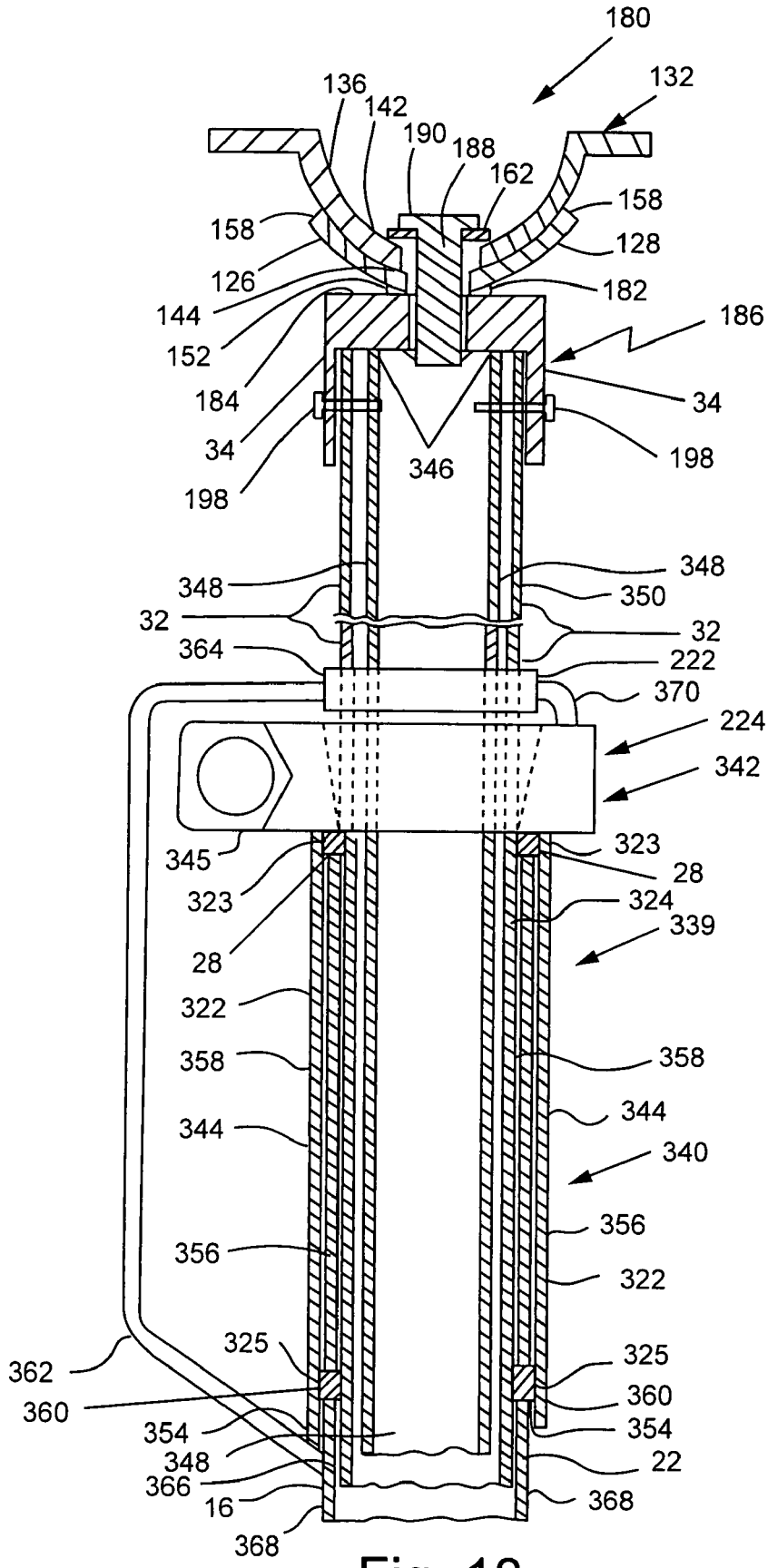
FIG. 18 is a sectional side view of clamp assembly having another non-limiting embodiment of a yield section that can be used in the practice of the invention, the yield section shown in cross section.

With reference to FIG. 18 there is shown another non-limiting embodiment of a yield section 340 used in combination the clamp assembly 62 (see FIG. 6), the bearing plate assemblies 180 (see FIGS. 4, 5 and 12) and the bearing plate assembly 180 shown in FIG. 18. As can be appreciated, the yield section 340 can be used with any bearing plate assembly of the invention, e.g. the bearing plate assemblies shown in FIGS. 1 and 2. Further, as can be appreciated, the yield section can be used with any type of clamping arrangement, e.g. one of the clamping assemblies shown in FIGS. 12-16, provided that the clamping arrangement secures the first and second conduits together to prevent the second conduit from sliding into the first conduit when a load is applied to the bearing plates. The yield section 340 is similar to the yield section 340 shown in FIG. 22 of U.S. Pat. No. 7,134,810 B2 and includes a shroud 344 secured to surface 345 of the housing 224. The end 346 of the inner pipe 348 and end of the second conduit 32 are secured in the end caps 186 of the bearing plate assembly 180 by the bolts 198 with the center axis of the inner pipe 348 and the second conduit 32 concentric. The upper follower ring 323, the insert 322, and the lower follower ring 325 are positioned in a space 354 between the outer surface 356 of the second conduit 32 and inner surface 358 of the shroud 344. The end 280 of the first conduit 22 is positioned in the space 354. A handle 362 has an end 364 secured to the collar 222 and the other end 366 secured to outer surface 74 of the first conduit 22 to secure components of the yield section 340 together in a similar manner as the handle 332 shown in FIG. 17 secured the components of the yield section 300 together. The collar 222 is attached to the housing 224 by handle 370 and a tie (not shown) similar to the tie 250 (see FIG. 6) maintains the second conduit 32 in the first conduit 22 as previously discussed.

As can be appreciated, the inner pipe 348 can be eliminated and the outer surface 68 of the second conduit 32 can be used to provide a wall for the space 354. The inner pipe 348 is recommended where the second conduit 32 is not considered to be strong enough to contain the insert 322 in the space 354 as it is compressed between the housing 342 and the first conduit 22.

Figure 19:
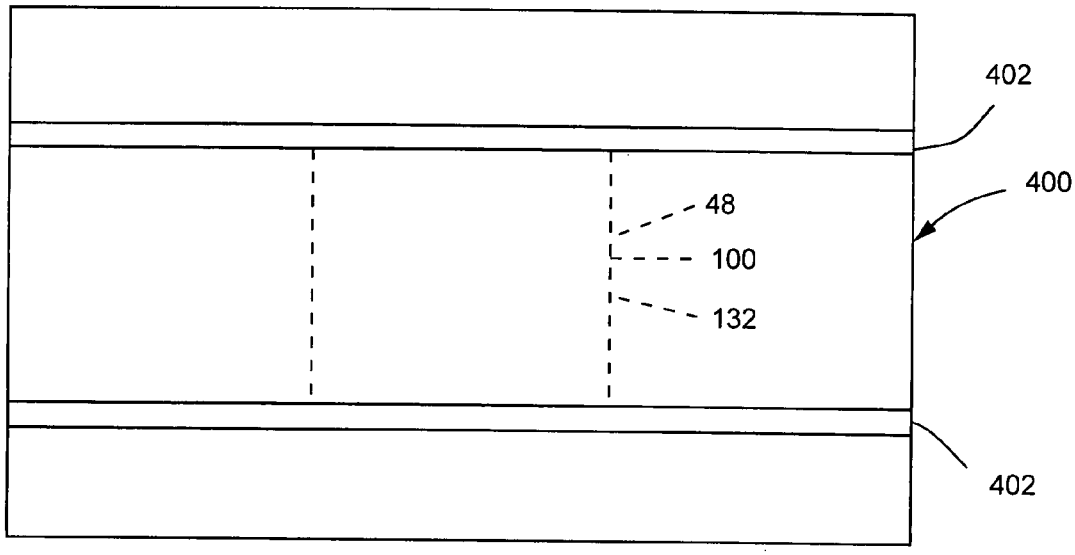
FIG. 19 is an elevated plane view of a non-limiting embodiment of the invention showing a monster plate mounted on the end plates of the invention.

With reference to FIG. 19, a further non-limiting embodiment includes a monster plate 400 with rib portions 402 that is mounted to an end plate, such as the bearing platform 48, bearing plate 100, or bearing plate 132 that were described above. Further with reference to FIG. 20, yet another non-limiting embodiment includes a beam bracket 410 mounted to an end plate, such as the bearing platform 48, bearing plate 100, or bearing plate 132 that were described above. The beam bracket 410 may be secured to one of the plates 48, 100, 132 via fasteners 412.

As is appreciated, the prop 10 incorporating features of the invention can be set by hand, or by a jack assembly, e.g. but not limited to a jack assembly of the type disclosed in U.S. Pat. No. 7,134,810 B2. Further, the invention contemplates setting the yieldable prop by hand. For example and not limiting to the invention, the prop 20 can be set by moving the left plate toward the roof and setting the clamp assembly 62 to secure the first and second conduits in position. Thereafter, the nut is rotated to move the plate member 48 of the bearing platform or the bearing plate assembly 120 against the roof of the mine.

As can be appreciated, the invention is not limited to the non-limiting embodiments of the invention discussed herein and modifications can be made without deviating from the scope of the invention, and the invention contemplates combining features of the non-limiting embodiments of the invention discussed herein.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A yieldable prop comprising:

a) at least one conduit having a first end and an opposite second end, and a hollow portion extending from the first end toward the second end, and b) a bearing plate assembly comprising:

1) a support member;

2) a threaded shaft having a first end and an opposite second end with the first end of the threaded shaft mounted to the support member, and 3) a body having a first side and an opposite second side with the first side of the body supported on the first end of the at least one conduit, the body being rotatable relative to the at least one conduit, the body having a threaded passageway to receive the threaded shaft with the second end of the threaded shaft in the first end of the at least one hollow conduit, wherein rotating the body in a first direction moves the support member to increase spaced distance between the support member and the first side of the body, and rotating the body in a second opposite direction moves the support member to decrease the spaced distance between the support member and the first side of the body, wherein the at least one conduit is a first conduit, and further comprising a hollow second conduit, the second conduit having a first end and an opposite second end with the first conduit slideably received in the first end of the second conduit, and a clamp assembly acting on outer surface portions of the first and second conduits, wherein the clamp assembly in an engaging position provides resistance to the first conduit moving into the second conduit, and the clamp assembly in the non-engaging position eliminates the resistance to the first conduit moving into the second conduit.

2. The yieldable prop according to claim 1, wherein the support member of the bearing plate assembly comprises a plate member having a first surface and an opposite second surface; a spacer block secured to the second surface of the plate member, and the first end of the threaded shaft fixedly mounted to the spacer block of the support member.

3. The yieldable prop according to claim 2, wherein the first side of the body is seated over the first end of the first conduit and further comprising a pair of elongated members mounted in spaced relationship to one another on an outer surface of the body.

4. The yieldable prop according to claim 3 further comprising a plate mounted on the outer surface portions of the first conduit adjacent to and spaced from the first end of the first conduit.

5. The yieldable prop according to claim 4, further comprising wherein the plate member is secured to the second end of the second conduit.

6. The yieldable prop according to claim 4, further comprising wherein the plate member is secured at the second end of the second conduit, and a collapsible insert at a location selected from between the clamp assembly and the first end of the second conduit, and the second end of the second conduit and the bearing plate.

7. The yieldable prop according to claim 1, wherein the body further comprises a sleeve extending from the first side of the body, with inner perimeter of the sleeve and outer perimeter of the first end of the first conduit sized relative to one another to rotatably mount the sleeve over the first end of the first conduit with the first end of the first conduit engaging the first side of the body.

8. The yieldable prop according to claim 1, wherein the support member of the bearing plate assembly comprises a plate member having a first surface and an opposite second surface, and a beam bracket mounted to the first surface of the plate member.

9. A yieldable prop comprising:

a) at least one conduit having a first end and an opposite second end, and a hollow portion extending from the first end toward the second end, and b) a bearing plate assembly comprising:

1) a support member;

2) a threaded shaft having a first end and an opposite second end with the first end of the threaded shaft mounted to the support member, and 3) a body having a first side and an opposite second side with the first side of the body supported on the first end of the at least one conduit, the body being rotatable relative to the at least one conduit, the body having a threaded passageway to receive the threaded shaft with the second end of the threaded shaft in the first end of the at least one hollow conduit, wherein rotating the body in a first direction moves the support member to increase spaced distance between the support member and the first side of the body, and rotating the body in a second opposite direction moves the support member to decrease the spaced distance between the support member and the first side of the body, wherein the body further comprises a sleeve extending from the first side of the body, with an inner perimeter of the sleeve and an outer perimeter of the first end of the at least one conduit sized relative to one another to rotatably mount the sleeve over the first end of the at least one conduit with the first end of the at least one conduit engaging the first side of the body, and a stop member passing through a wall of the sleeve and engaging the at least one conduit to securely fix the body on the first end of the at least one conduit.

10. The yieldable prop according to claim 9 further comprising a pair of elongated members mounted in spaced relationship to one another on an outer surface of the body and a layer of a low friction material between the outer surface portions of the at least one conduit and the inner surfaces of the body.

11. The yieldable prop according to claim 10, wherein the at least one conduit is a first conduit, and further comprising a hollow second conduit, the second conduit having a first end and an opposite second end with the first conduit slideably received in the first end of the second conduit; a bearing plate secured to the second end of the second conduit, and a clamp assembly acting on the outer surface portions of the first and second conduits at the juncture of the first and second conduits, wherein the clamp assembly in an engaging position provides resistance to the first conduit moving into the second conduit, and the clamp assembly in the non-engaging position eliminates the resistance to the first conduit moving into the second conduit.

12. The yieldable prop according to claim 10, wherein the at least one conduit is a first conduit, and further comprising a hollow second conduit, the second conduit having a first end and an opposite second end with the first conduit slideably received in the first end of the second conduit; a bearing plate at the second end of the second conduit, a clamp assembly acting on at least the outer surface portions of the first conduit, and a collapsible insert at a location selected from between the clamp assembly and the first end of the second conduit, and the second end of the second conduit and the bearing plate wherein the clamp assembly in an engaging position provides resistance to the first conduit moving into the second conduit, and the clamp assembly in the non-engaging position eliminates the resistance to the first conduit moving into the second conduit.

* * * * *

UNITED STATES PATENT AND TRADEMARK OFFICE

CERTIFICATE OF CORRECTION

PATENT NO. : 8,052,352 B2
APPLICATION NO. : 11/732067
DATED : November 8, 2011
INVENTOR(S) : Wallace Bolton It is certified that error appears in the above-identified patent and that said Letters Patent is hereby corrected as shown below:

Column 14, Line 20, Claim 10, after “and” delete “the”

Signed and Sealed this
Sixth Day of March, 2012

David J. Kappos

David J. Kappos
*Director of the United States Patent and Trademark Office*